United States Patent [19]

Kaldenbach

[11] Patent Number: 4,588,003

[45] Date of Patent: May 13, 1986

[54] REFUSE PACKAGING ASSEMBLY

[75] Inventor: Erwin Kaldenbach, Ratingen, Fed. Rep. of Germany

[73] Assignee: Lindemann Maschinenfabrik GmbH, Düsseldorf, Fed. Rep. of Germany

[21] Appl. No.: 597,429

[22] Filed: Apr. 6, 1984

[30] Foreign Application Priority Data

Apr. 7, 1983 [DE] Fed. Rep. of Germany ..... 3312445

[51] Int. Cl.[4] ..... B65B 1/24

[52] U.S. Cl. ..... 141/71; 141/258; 100/229 A; 100/295

[58] Field of Search ..... 141/1-12, 141/250-284, 71-80; 100/229 A, 295

[56] References Cited

U.S. PATENT DOCUMENTS

| | | | |
|---|---|---|---|
| 3,129,657 | 4/1964 | Farley et al. | 100/229 A |
| 3,880,072 | 4/1975 | Ord | 100/229 A |
| 4,099,457 | 7/1978 | Hyden | 100/229 A |

FOREIGN PATENT DOCUMENTS

| | | | |
|---|---|---|---|
| 54-15374 | 2/1979 | Japan | 100/229 A |

*Primary Examiner*—Houston S. Bell, Jr.

*Attorney, Agent, or Firm*—Toren, McGeady, Stanger, Goldberg & Kiel

[57] ABSTRACT

A refuse packaging assembly of the kind comprising a refuse press having a pressing plunger which is axially movable in a pressing box, and a container which is adapted to be connected to the outlet end of the pressing box in order to be filled with refuse by the plunger, the container having a closure plug which is uncoupled from the container and coupled to the plunger for movement therewith when the container is connected to the press. The container carries at least one spring loaded pin which is biased into a coupling aperture in the closure plug to couple the two together, and the plunger carries at least one weaker spring loaded pin which aligns with the coupling aperture when the container is moved into position for connection to the press and the plunger is moved to a coupling position. A coupling lever which is operated by a power actuator to securely hold the container connected to the press simultaneously acts to retract the container pin from the coupling aperture, thereby uncoupling the plug from the container and allowing the plunger pin to move into the aperture to couple the plug to the plunger. Releasing the coupling lever automatically leads to uncoupling of the closure plug from the plunger and recoupling to the container.

9 Claims, 5 Drawing Figures

REFUSE PACKAGING ASSEMBLY

BACKGROUND TO THE INVENTION

This invention relates to a refuse packaging assembly of the kind comprising a refuse press and a container adapted to be attached to said refuse press for filling thereby, wherein said refuse press includes a press box having an outlet at one end thereof, and a pressing plunger disposed in said press box for axial movement therethrough, said container includes means defining a filling opening, and a closure plug adapted to be coupled to said container to close said filling opening and also adapted to be coupled to said plunger, and wherein said assembly includes means for connecting said container to said press with said filling opening aligned with said press box outlet, first coupling means for coupling and uncoupling said closure plug to and from said container, and second coupling means for coupling and uncoupling said closure plug to and from said pressing plunger. The closure plug of the container is coupled to the pressing plunger when the container is connected to the press and travels with the pressing plunger as a front-mounted pressing plate during the pressing operation and during the filling of the container.

An assembly of this type is disclosed in DE-PS No. 2 207 600. In this case the uncoupling of the closure plug from the container at the start of the filling operation, in order to be coupled to the pressing plunger, and also the re-coupling of the plug to the container in order to close the container before it is separated from the press after the filling operation has been completed, is controlled by a different drive from the coupling of the closure plug to the pressing plunger. The refuse packaging assembly thus has, for carrying out the above control functions, two drives acting independently of each other. In more detail, after the container has been fitted to the refuse press, so-called pawls, which are disposed in the logitudinal walls of the container and are connected together by pull-out finger rods, first enter the movement region of inclined pins. These inclined pins are disposed on opposite sides of the press, and are then pressed by a drive in the form of a cylinder of electromagnet against a spring force and against the pull-out finger rods to cause the pawls to move out of detents which are located in the container closure plug and in which the pawls engage to secure the plug to the container. The closure plate, which is thus detached from the container, is then taken over by the advanced pressing plunger, coupling of the closure plug to the pressing plunger being effected by a further drive mechanism comprising electromagnets or an electromechanical locking device, which requires complicated hooking, centering pin and pawl assemblies.

The principal disadvantage of a refuse packing assembly of this type is the considerable constructional cost, which is associated with the two power drives which are required for connecting the container to the refuse press and for coupling the pressing plunger to the closure plug. Added to this is the fact that, in the coupling of the closure plug of the container to the pressing plunger, the exact positioning of the pressing plunger relative to the hooks and centering pins mounted on the closure plug is very troublesome. The individual control functions, i.e. the coupling of the container to the press and the taking-over of the closure plug by the pressing plunger, and the supervision associated therewith, must be initiated or carried out by operating personnel. The personnel costs associated with the deployment of the necessary operating personnel are highly uneconomical for the operator of the refuse packaging plant.

Due both to the number of the drives required and the resultant technical complexity, and to the number of the functional sequences required during the coupling and uncoupling of the container and press, the plant involves an unreasonable method of operating and long exchange times during the filling of the different containers. As a consequence, this refuse packaging assembly has a poor efficiency, resulting from the unfavourable ratio between the possible output capability of the refuse press to the actual packaging of refuse permitted by the time-consuming coupling and uncoupling operations.

Also, faults can occur in this known assembly because of the fact that neither the container nor the press of necessity possesses devices for controlling the locking operation or locking elements which can hold the container in alignment with the refuse press (in the filling position) during filling of the container.

SUMMARY OF THE INVENTION

The task underlying the present invention is to provide a refuse packaging assembly of the type initially described which is reliable, requires minimum personnel attendance, and makes possible a particularly rapid and trouble-free coupling and uncoupling operation whereby changing of containers is adapted in optimum manner to the output capability of the press.

According to the invention this task is achieved in a refuse packaging assembly of the kind described by the improvement wherein said first and second coupling means comprises at least one first coupling pin carried by said container, at least one second coupling pin carried by said pressing plunger, means defining at least one coupling aperture in said closure plug, said first and second coupling pins and said coupling aperture being axially aligned with each other when said container is connected to said press and said pressing plunger is in a coupling position, and a common operating mechanism for connecting said container to said press and for moving said first and second coupling pins into and out of said coupling aperture to couple said closure plug from said container to said pressing plunger and vice versa, said operating mechanism including a power actuator.

In a surprisingly simple manner the features according to the invention enable the connecting of the container to the refuse press to be carried out completely automatically, and functionally reliable and rapid coupling of the closure plug of the container to the pressing plunger, controlled by only a single, common drive.

Furthermore, by the single, common drive associated with the connecting and coupling operations, a functional fusing of the interlocking working sequences, i.e. connection of the container to the press and the taking-over of the closure plug of the container by the plunger, is achieved. As a result of the fully automatic procedure and the successive releasing of the pins which are functionally associated and of the machine elements connected with them, the manual activity normally required for the initiating of various control functions is dispensed with. Unnecessary waiting time during changing of the containers which, for example, can be caused by inattentive personnel, is reliably avoided with a refuse packaging assembly in accordance with the invention by the full automating of the working sequence.

In a preferred embodiment of the invention, the operating mechanism includes first and second biassing springs acting on said first and second coupling pins respectively. When connecting the container to the press, the first spring associated with the container is first overcome by the common drive so that the first coupling pin which secures the closure plug to the container is retracted from the aperture in the closure plug in order to free the plug for the succeeding, automatically triggered coupling operation of the advancing pressing plunger with the closure plug. Advantageously, therefore, the force of the second spring acting on the second coupling pin carried by the pressing plunger acts in the opposite direction to the force of the first spring, thereby ensuring that, after the first coupling pin has been retracted from the aperture in the closure plug, the second coupling pin is forced by the second spring automatically into the vacated aperture, so that the closure plug is connected to the pressing plunger.

When the filling operation has been completed, the container is uncoupled from the press, and for this purpose the power actuator of the common operating mechanism is first shut off. In order that the closure plug is automatically released from the pressing plunger and recoupled to the container to close the filling opening, the force of the spring carried by the container and acting on the first coupling pin is preferably larger than the force of the spring acting on the second coupling pin and carried by the plunger. In this manner, the first coupling pin carried by the container will press the second pin back out of the aperture in the closure plug sufficiently far for the container to be transported away with the closure plug once again secured thereto by the first pin.

When fitting a new container to the press, the second coupling pin carried by the pressing plunger is pressed outwards by the second biassing spring and constitutes an obstruction to be overcome. Preferably therefore, the end of the side wall of the closure plug which faces towards the pressing plunger possesses a chamfered run-on surface. With this arrangement, when the run-on surface meets the coupling pin projecting from the plunger, the pin yields to the steadily advancing container against the force of its biassing spring and follows the course of the run-on surface, thus enabling the container to be connected to the press and the plunger to adopt the coupling position.

BRIEF DESCRIPTION OF THE DRAWINGS

A preferred embodiment of the invention is illustrated in the accompanying drawings, in which.

DESCRIPTION OF THE PREFERRED EMBODIMENT

Figure 1:
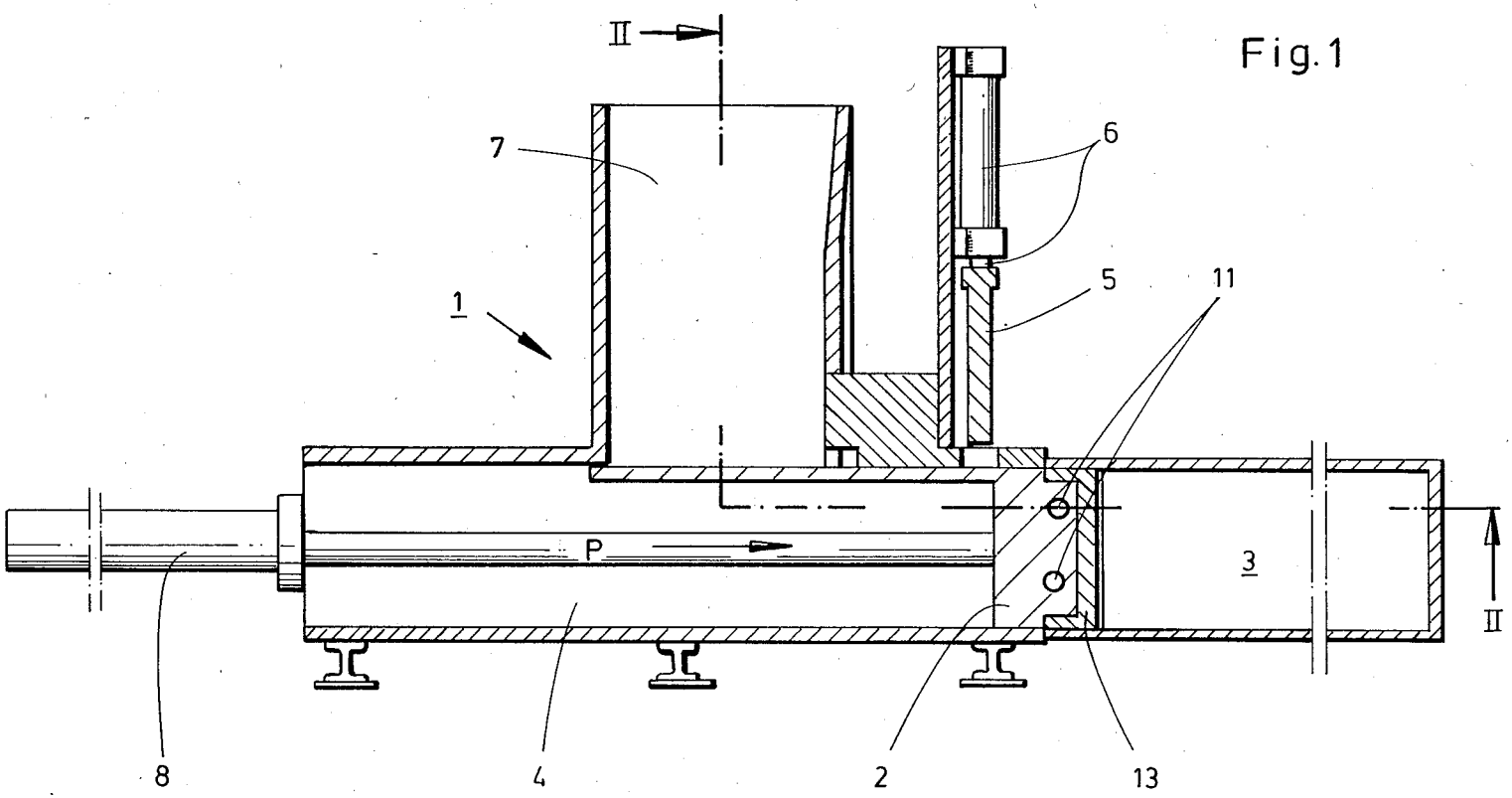
FIG. 1 is a vertical sectional view through the refuse packaging assembly, taken along the line I—I in FIG. 2.
Figure 2:
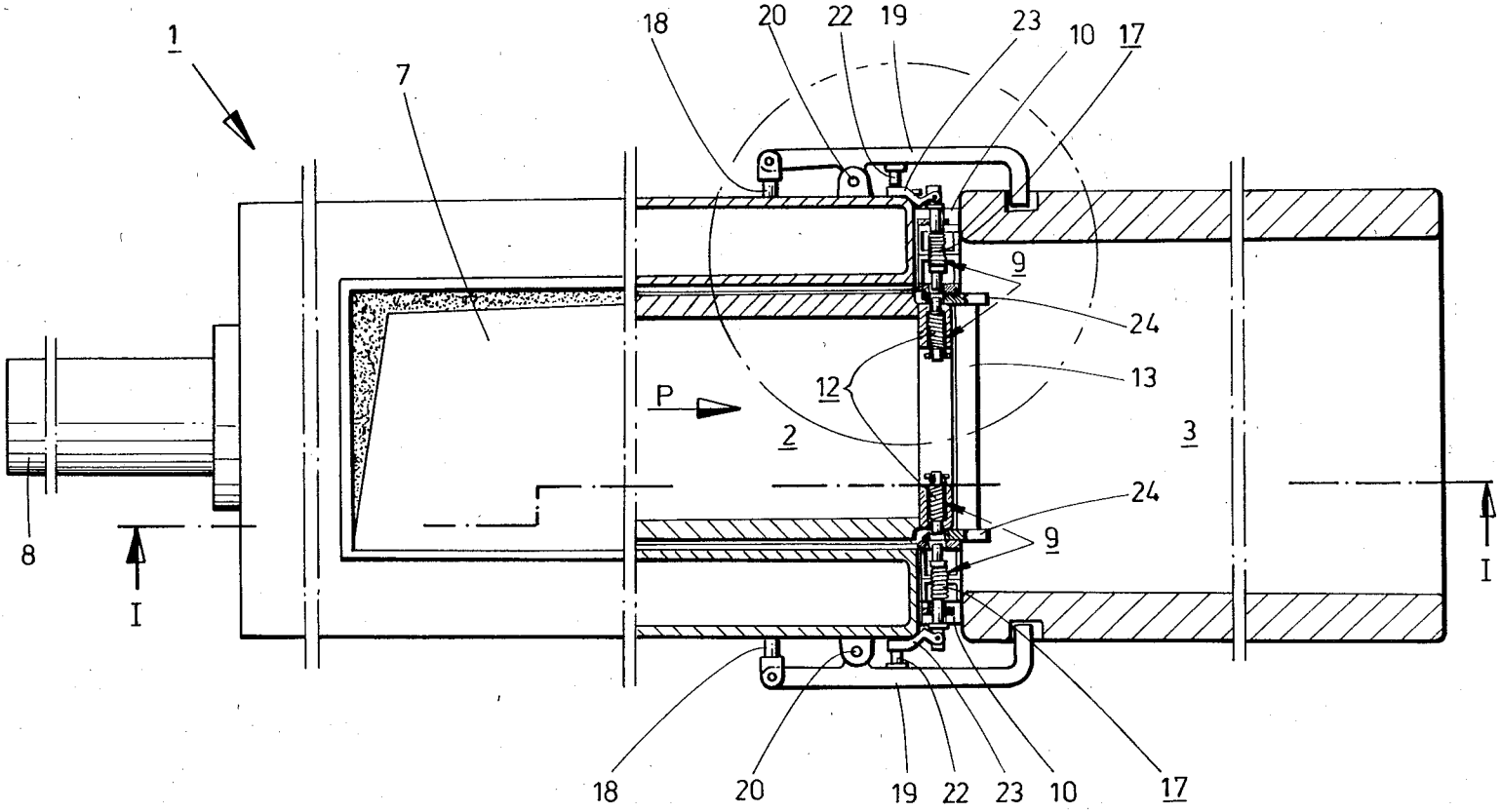
FIG. 2 is an enlarged plan view of the assembly, partly in section along the line II—II in FIG. 1; and, FIGS. *3a* to *3c* are enlarged sectional views corresponding to the circled portion of the assembly shown in FIG. 2 showing different phases of operation of the assembly.

The refuse packaging assembly illustrated comprises a press 1 and a container 3 arranged to be connected to the press in order to be filled with refuse from a horizontal pressing box 4 by means of a pressing plunger 2 which is reciprocated through the box 4. The pressing box 4 can be closed, near its end to which the container 3 is connected, by a vertically slidable plate 5 for the case when the refuse is to be prepressed. The plate 5 is raised and lowered by a hydraulic drive 6, and is shown in FIG. 1 in the raised position. In the lowered position, the plate 5 closes the pressing box 4. By pre-pressing the refuse against the plate 5, the packing density in the container, into which the pressed refuse is subsequently pushed, can be considerably increased independently of the varying composition of the refuse. If exact requirements regarding density are not imposed, it is possible to press the material directly into the container, instead of against the plate 5. A filling shaft 7, through which the refuse to be compressed and packaged is introduced, leads from above into the pressing box 4. The plunger 2, which is operated by a further hydraulic drive 8, acts both as a conveying plunger and also as a pressing plunger.

It may be mentioned at this point that the assembly is provided, on each side of the container 3 and press 1, with a pair of coupling and uncoupling devices 9, only one of which will be described in detail below for the sake of simplicity.

Each device 9 is disposed, in the example illustrated, partly in a container door 10 and partly in the pressing plunger 2. However, instead of arranging part of the device 9 in the door 10 of the container, it could equally well be located in the longitudinal wall of the container, or in the base or the lid of the container. The part of the device 9 housed in the pressing plunger 2 comprises a pin 11 and a spring-loaded biassing element 12 acting on the pin 11. In the example illustrated, this element 12 is a mechanical spring $F_1$, but the use of equivalent means is equally possible. Before a container is connected to the press 1 the biassing element 12 is unstressed, and the pin 11 projects out of the side wall *2a* of the pressing plunger 2, as shown in FIG. *3a*.

Beyond the outlet end of the press box 4, there is situated in alignment therewith a container 3 having the door 10 with an opening closed by a closure plug 13. The plug 13 is secured to the container 3 by pins 14 which are parts of the devices 9 and which engage in mutually aligned bores 15, 16 disposed in the container door 10 and in the closure plug 13 respectively. Each bore 16 in the closure plug 13 is designated, in the context of this invention, also as a "coupling aperture", since it serves to receive one or other of the pins 11, 14 of the relevant device 9 to couple the closure plug 13 either to the pressing plunger 2 or to the container 3. Each pin 14 associated with the container 3 is acted upon by a spring-loaded biassing element 17, which in the present case is a mechanical spring $F_2$. The spring $F_2$ is unstressed when the container is uncoupled from the press 1, holding the pin in the bores 15, 16 to couple the plug 13 to the container. The forces of the springs $F_1$, $F_2$ act in opposite directions, and furthermore the force of the spring $F_2$ associated with the container 3 is larger than the force of the spring $F_1$ associated with the pressing plunger 2.

The devices 9 on each side of the pressing plunger 2 and container 3 are arranged to be operated by a power actuator 18, for example a hydraulic cylinder, which is fixed to the press 1. The power actuator 18 acts upon a coupling lever 19 which is pivotally mounted on the press 1 about a pivot axis 20, and is also arranged to hold the container securely in position when it is connected to the press for filling, the end of the coupling lever 19 engaging in a recess 21 on the container 3. At a distance from the pivot axis 20, the coupling lever 19 carries a pressure piece 22 which is arranged to act upon a lever 23 fixed to the pin 14. When the container 3 is coupled to the press 1, the pressure piece 22 presses down this lever 23, which retracts the pin 14 from the coupling aperture 16 in the closure plug 13 against the action of the biassing spring 17. As mentioned earlier, there are a pair of similar devices 9 on each side of the container, and the pins 14 are connected together by means (not shown) so that they are operated synchronously when the actuator 18 is operated.

The coupling apertures 16 of the closure plug 13 are located in a side wall 24 extending perpendicularly from the principal face of the plug 13, and the inner surface 24*a* of this side wall 24 has a chamfered lead-in surface 25. As will be explained below this is of importance for the engagement of the pressing plunger pins 11 with the closure plug 13 ready for coupling thereto.

The operation of the above-described refuse packaging assembly will now be explained with reference to FIGS. 3*a* to 3*c*.

Before connecting the container 3 to the press 1, the pressing plunger 2 is advanced as far as the position shown in FIG. 3*a*, in which coupling of the closure plug 13 of the container to the pressing plunger 2 can subsequently take place. The container 3 is then brought up to the press 1 so that the chamfered lead-in surface 25 of the closure plug 13 meets the pins 11 projecting out of the pressing plunger 2, and on further advancement of the container 3 towards the press 1, each pin 11 follows the chamfered surface 25 and is forced inwards into its bore 26 in the plunger surface 2*a* against the biassing force of its spring 12. The container 3 is advanced until the bores 15, 16, and 26 (in the container door 10, closure plug 13, and pressing plunger 2 respectively) are in alignment with one another, as illustrated in FIG. 3*c*. At this stage the pins 14, which are carried by the container 3 and secure the closure plug 13 to the container 3, engage and hold the pins 11 in their retracted position in the plunger 2 by virtue of the springs 17 which act on the pins 14 being stronger than the springs 12 acting on the pins 11.

Figure 3A:
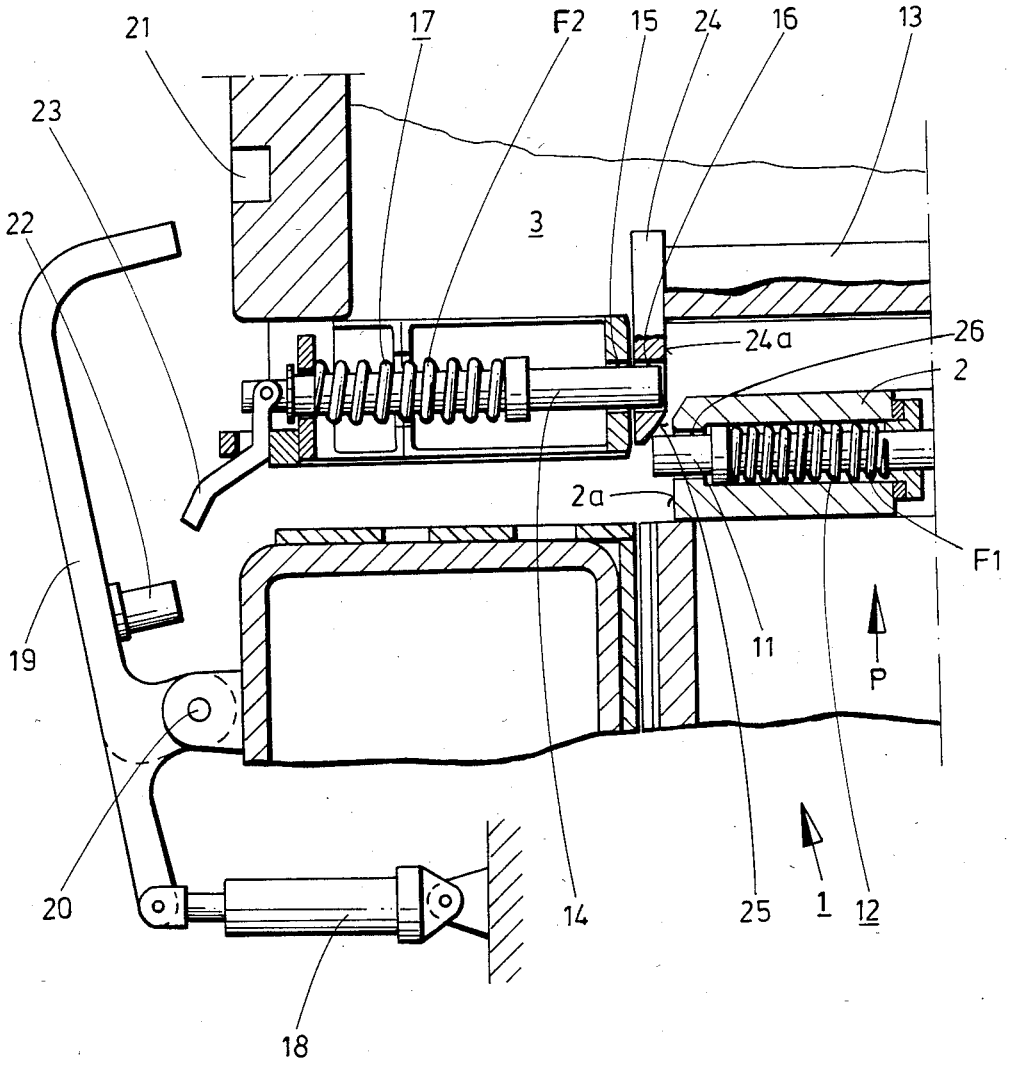
Figure 3B:
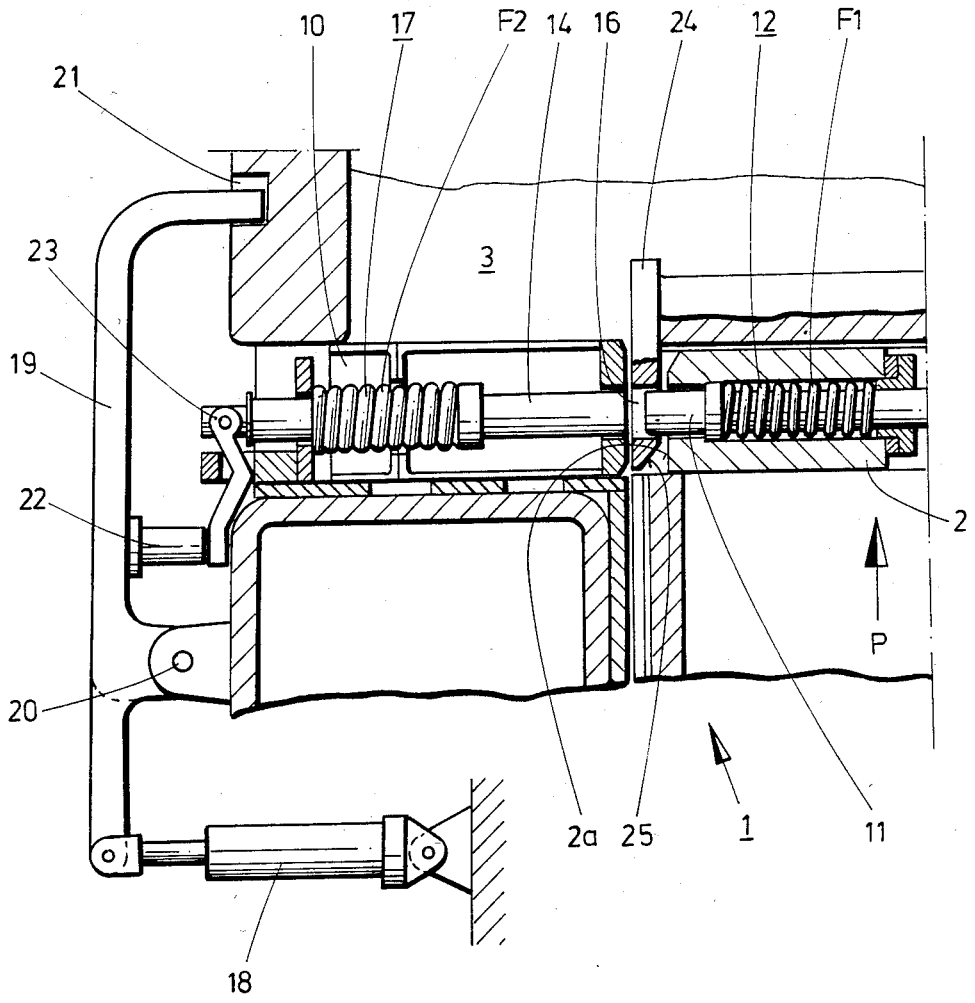
Figure 3C:
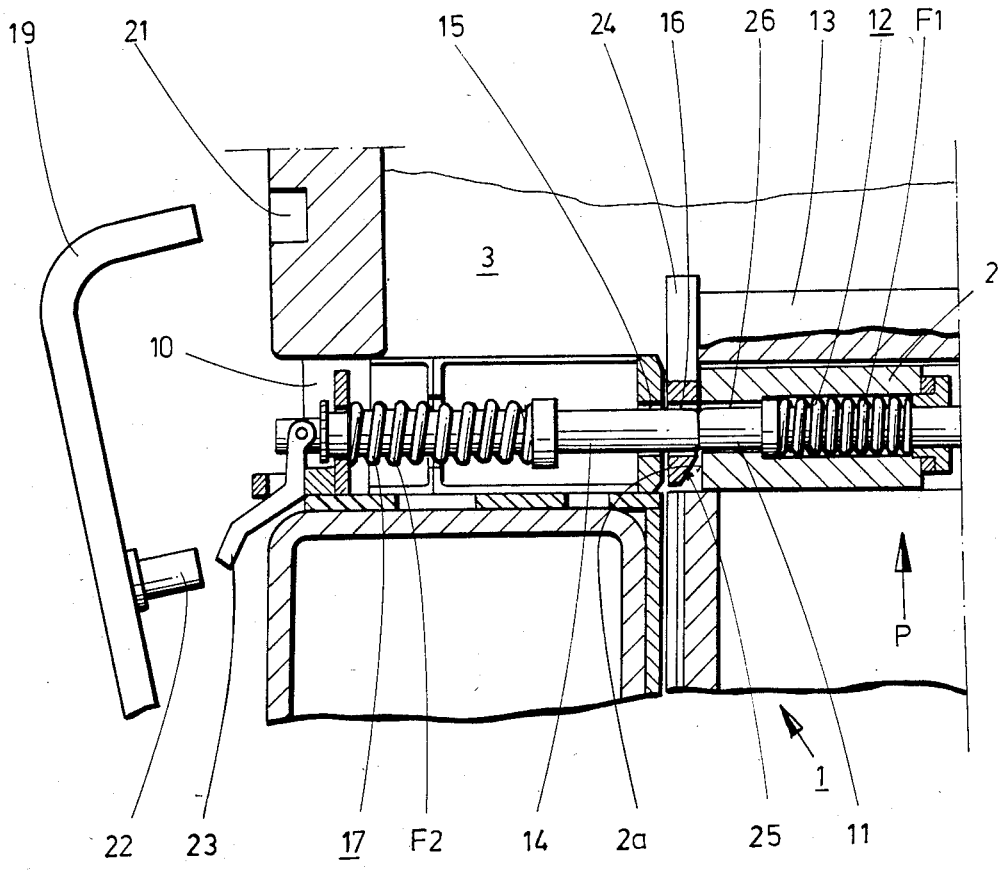

The actuator 18 is then operated to pivot the coupling lever 19 from the position shown in FIG. 3*a* to that shown in FIG. 3*b*. By this operation, on the one hand the container 3 is connected securely to the press 1, and on the other hand the closure plug 13 is simultaneously uncoupled from the container 3 and coupled to the plunger 2. As the end of the lever 19 moves into the recess 21, the pressure piece 22 engages and depresses the lever 23, causing the pin 14 to be retracted from the bore 16 of the closure plug 13 against the action of the spring $F_2$, and hence allowing the pin 11 associated with the pressing plunger 2 to be pushed automatically by its biassing spring $F_1$ into the coupling bore or aperture 16. In this condition, the container 3 is firmly connected to the refuse press 1 while the pressing plunger 2 is now coupled to the closure plug 13, which thereafter during the pressing operation and filling of the container moves with the plunger as a front-mounted pressing plate.

Technically speaking, it is also possible within the scope of this invention to reverse the kinematic arrangement of the above-described assembly or coupling sequence, by making the force of the spring $F_1$ associated with the pressing plunger 2 larger than the force of the spring $F_2$ associated with the container 3. The resetting of the spring biassing element 17 of the container 3—and respectively the coupling of the closure plug 13 to the container 3—from the position shown in FIG. 3*b* to that shown in FIG. 3*c* could, for example, be achieved via an intermediately connected restoring spring (not shown) which would be stressed by the lever 23 via the common actuator 18 and which would be able to compress the spring $F_1$ utilizing the transmission in the lever 23.

Also conceivable would be the less effective coupling procedure in which the container 3 is fitted to the press 1 and the pressing plunger 2 then advanced into the coupling position. Each pin 11 projecting from the plunger 2 would likewise encounter the chamfered lead-in surface 25 of the side wall 24 of the closure plug 13 and follow its course, causing the pin to be deflected against the force of its biassing spring $F_1$ and to be pushed into the pressing plunger 2. As soon as the plunger 2 has reached its limiting position, as shown in FIG. 3*b*, the bores 15, 16 and 26 oriented transversely to the direction of movement P are in alignment, and the coupling lever 19 is operated to connect the container 3 to the press 1 and to retract the pin 14 associated with the container from the bore 16 of the closure plug 13 as described earlier so that the pin 11 then moves into the bore 16 instead.

After filling of the container 3 is completed, the coupling lever 19 is released, allowing the spring biassing element 17 associated with the container 3 to expand and accordingly force the pin 14 back into the bore 16 of the closure plug 13 to recouple the plug to the container. Due to the larger force of the spring $F_2$ than the spring $F_1$, the pin 11 associated with the pressing plunger 2 is fully pushed out of the bore 16 so that the coupling between pressing plunger 2 and the closure plug 13 is released and the container 3 is again closed by the closure plug (see FIG. 3*c*). The filled container 3, uncoupled from the press 1, can then be transported away and a new container can be connected to the press.

I claim:

1. In a refuse packaging assembly comprising a refuse press and a container adapted to be attached to said refuse press for filling thereby, wherein said refuse press includes a press box having an outlet at one end thereof, and a pressing plunger disposed in said press box for axial movement therethrough, said container including means defining a filling opening, and a closure plug adapted to close said filling opening and wherein said assembly includes a releasable connecting means for coupling said closure plug to said pressure plunger, the improvement which comprises that said releasable connecting means includes a common power drive, at least one pair of cooperating pins actuated by said common power drive, one pin of each pair being associated with the pressing plunger while the other pin is associated with the container and both pins of each pair in coupling position are capable of engaging a coupling bore of the closure plug in coaxially, opposite directions, and said connecting means includes means actuated by said common power drive for releasably connecting said container to said press box so that said container can be connected to said press box when said pressing plunger is connected to said closure plug and when said container is released from said press box said closure plug is connected to said container.

2. In a refuse packaging assembly comprising a refuse press and a container adapted to be attached to said refuse press for filling thereby, wherein said refuse press includes a press box having an outlet at one end thereof, and a pressing plunger disposed in said press box for axial movement therethrough, said container includes means defining a filling opening, and a closure plug adapted to be coupled to said container to close said filling openings and also adapted to be coupled to said plunger, and wherein said assembly includes means for connecting said container to said press box with said filling opening aligned with said press box outlet, first coupling means for coupling and uncoupling said closure plug to and from said container, and second coupling means for coupling and uncoupling said closure plug to and from said pressing plunger, the improvement wherein said first and second coupling means comprises at least one first coupling pin carried by said container, at least one second coupling pin carried by said pressing plunger, and means defining at least one coupling aperture in said closure plug, said first and second coupling pins and said coupling aperture being axially aligned with each other when said container is connected to said press box and said pressing plunger is in coupling position, and a common operating mechanism for connecting said container to said press box and for moving said first and second coupling pins into and out of said coupling aperture.

3. An assembly according to claim 2, wherein said first and second coupling pins extend perpendicularly to the direction of movement of said pressing plunger.

4. An assembly according to claim 3, wherein said closure plug has a principal surface oriented perpendicularly to the direction of movement of said pressing plunger, and at least one side wall extending perpendicularly to said principal surface, and said coupling aperture is located in said side wall.

5. An assembly according to claim 2, wherein said operating mechanism includes first and second biassing springs acting on said first and second coupling pins respectively.

6. An assembly according to claim 5, wherein said first and second biassing springs bias said first and second coupling pins in opposite directions towards each other.

7. An assembly according to claim 6, wherein said first biassing spring acting on said first coupling pin is stronger than said second biassing spring acting on said second coupling pin.

8. An assembly according to claim 4, wherein the end of said side wall facing towards said pressing plunger has a chamfered lead-in surface for said second coupling pin carried by said pressing plunger.

9. An assembly according to claim 2, wherein said first coupling means is disposed in a door, a longitudinal wall, a base, or a lid of said container.

* * * * *